US005415244A

United States Patent [19]

Portwood

[11] Patent Number: 5,415,244

[45] Date of Patent: May 16, 1995

[54] CONICAL INSERTS FOR ROLLING CONE ROCK BITS

[75] Inventor: Gary Portwood, Katy, Tex.

[73] Assignee: Smith International, Inc., Houston, Tex.

[21] Appl. No.: 203,052

[22] Filed: Feb. 28, 1994

[51] Int. Cl.[6] ..... E21B 10/52; E21B 10/58

[52] U.S. Cl. ..... 175/374; 175/430

[58] Field of Search ..... 175/374, 426, 430

[56] References Cited

U.S. PATENT DOCUMENTS 3,442,342 5/1969 McElya et al. .

4,108,260 8/1978 Bozarth ..... 175/374

4,334,586 5/1982 Schumacher ..... 175/374

4,776,413 10/1988 Forsberg ..... 175/410

5,322,138 6/1994 Siracki ..... 175/426

*Primary Examiner*—William P. Neuder

*Attorney, Agent, or Firm*—Robert M. Vargo

[57] ABSTRACT

A conical insert is disclosed having a cutting tip which includes a spherically shaped apex and a substantially conical surface therebelow. The trailing side of the cutting tip is convex as seen in the longitudinal section taken normal to the apex. The leading side of the cutting tip is either a straight line segment or is concave as seen in the longitudinal section taken normal to the apex.

19 Claims, 2 Drawing Sheets

CONICAL INSERTS FOR ROLLING CONE ROCK BITS

BACKGROUND OF THE INVENTION

I. FIELD OF THE INVENTION

This invention relates generally to inserts for rolling cone rock bits and more particularly to conical type inserts having specially shaped cutting tips.

II. DESCRIPTION OF THE PRIOR ART

Rock bits using sintered tungsten carbide inserts with cutting tips having a generally wedge or chisel-shaped configuration have been used for drilling soft and medium formations. Various configurations of wedge-shaped inserts are shown in U.S. Pat. No. 3,442,342. Inserts of this type usually have a pair of cylindrical flanks that converge into an elongated rounded crest.

U.S. Pat. No. 4,018,260 shows a modified version of the chisel-shaped inserts in which the leading flank is concave and the trailing flank is convex. The scoop-shaped leading flank aids in lifting cuttings while the convex trailing flank resists breakage because of the additional support provided.

A shortcoming with the scooped inserts of the '260 patent is that the flank surfaces are flat and intersect the side conical surfaces at sharp angles, thereby creating stress risers which promote breakage.

Recently, conical inserts have been utilized in rock bits for drilling soft, medium and hard formations. Conical inserts include a cylindrical base and a cutting tip comprising a conical surface concentric with the insert axis converging into a spherically shaped apex.

U.S. Pat. No. 4,334,586 illustrates a plurality of conical type inserts in which the spherical crowns are asymmetrical with respect to the insert axes. On these inserts, the side surface of the cutting tip below the crown includes straight line surfaces between the base of the cutting tip and the crown to form an oblique cone structure. (See FIGS. 3 and 4 of the above mentioned patent.)

U.S. Pat. No. 4,776,413 teaches the use of a conical type cutter having a spherical apex with the side surface between the base of the cutting tip and the apex being a concave surface of revolution.

Another conical type insert commonly used is an "ogive" insert having a symmetrical convex surface forming the cutting tip. The problem with such an insert is that the extra material forming the convex surface caused less penetration and lower rates of penetration. Such inserts are typically used for hard formations only.

SUMMARY OF THE INVENTION

In accordance with the present invention, a conical insert is provided having a cylindrical base and a cutting tip. The cutting tip includes a spherically shaped apex and a substantially conical surface between the apex and the base. In the preferred embodiments, the trailing side of the cutting tip is convex as seen in the longitudinal section taken normal to the apex. The leading side of the cutting tip is either a straight line segment or is concave as seen in the longitudinal section taken normal to the apex.

The surface between the base and the apex is further characterized by the fact that no sharp bends are present giving cause for stress risers.

An advantage of the present invention is that such a construction provides for more durability and can be made with greater extensions.

It will of course be realized that various modifications can be made in the design and operation of the present invention without departing from the spirit thereof. Thus while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

DESCRIPTION OF THE PREFERRED EMBODIMENTS AND BEST MODE FOR CARRYING OUT THE INVENTION

Figure 1:
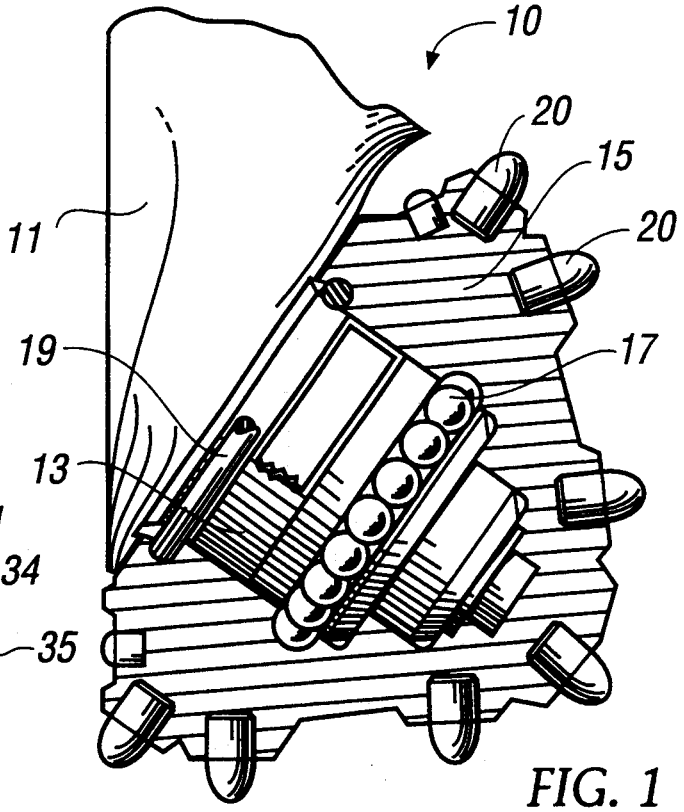
FIG. 1 is a fragmentary sectional view of one of the three sections of a rolling cone rock bit having inserts constructed in accordance with the present invention.

FIG. 1 illustrates a portion of a rolling cone rock bit 10 having a leg 11 extending downwardly from a bit main body (not shown). A journal 13 extends from the leg 11 for rotatively supporting a cone 15. The journal 13 includes friction beating stirfaces which mate with corresponding bearing surfaces on the interior of the cone 15.

A plurality of ball bearings 17 are located within a chamber formed by registering grooves located on the journal and within the cone. The balls function to retain the cone on the journal.

An o-ring 19 is positioned within a gland formed by the journal and the cone to seal the interior of the cone from the exterior of the bit.

Although only one leg and cone assembly is shown, each rock bit normally includes two or three such assemblies.

Each cone 15 includes a plurality of cutting inserts 20 located in rows to project out of the borehole and the bit and cone rotate. Each insert 20 is usually made of a hard material such as sintered tungsten carbide.

Figure 3:
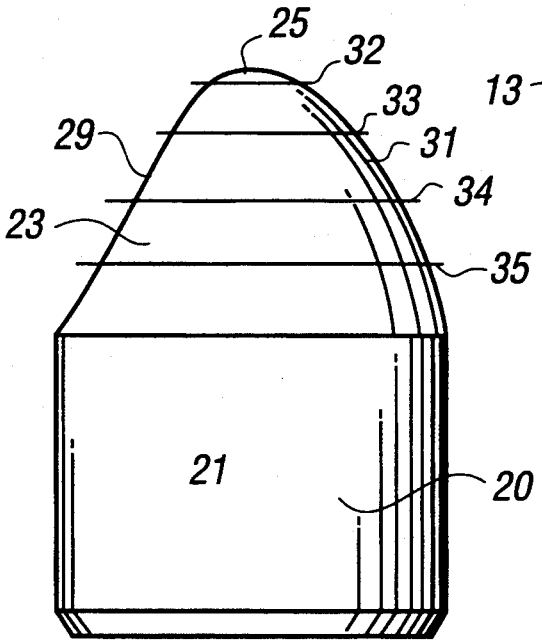
FIG. 3 is a side elevational view of the insert shown in FIG. 2.
Figure 2:
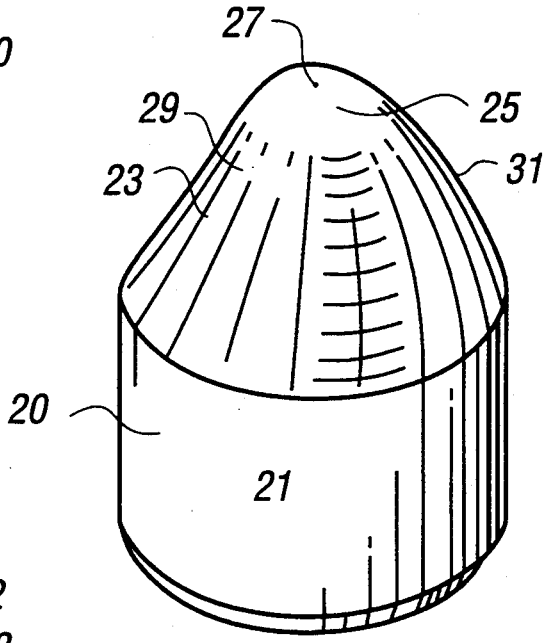
FIG. 2 is a perspective view of the first embodiment of the insert of the present invention.
Figure 4:
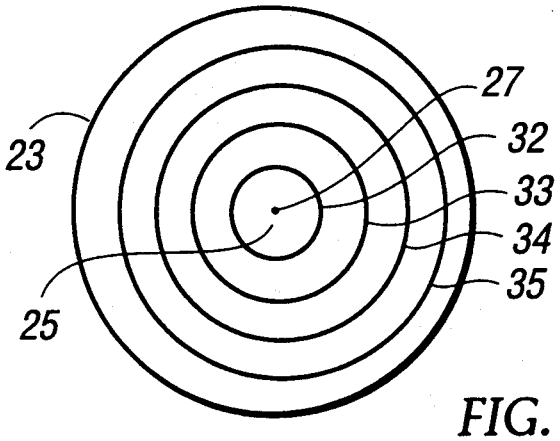
FIG. 4 is a top elevational view of the insert showing surface lines taken at various elevations of the cutting tip.

FIGS. 2–4 illustrate the insert 20 made in accordance with the present invention. Each insert 20 includes a cylindrical base 21 which is adapted to extend entirely within bores formed in the cone. Each insert 20 also includes a cutting tip 23 which is adapted to extend beyond the surface of the cone 15.

Each cutting tip 23 can be separated into three sections for descriptive purposes. The first section is the substantially spherical or rounded apex 25. The very top of the apex 25 forms a point 27. The rounded surface of the apex 25 applies a high loading on the formation surface to be drilled in order to fracture portions of the formation away from the borehole bottom.

The side surface below the apex 25 can be divided into the forward or leading section 29 and the rear or trailing section 31. Each insert 20 is positioned and oriented on the cone 15 such that the leading section 29 located at the top of the cone faces the direction of travel of the cone to contact the formation first as each insert rolls onto the bottom surface of the borehole. With such an orientation, the trailing section 31 of each insert 20, when its at the top of the cone, faces away from the direction of travel of the cone.

The leading section 29 is frusto-conical in shape which has straight line segments extending from the base 21 to the apex 25. It should be noted that the leading section 29 and the trailing surface 31 form a contoured surface that does not have an abrupt change in direction on it requiring blending or rounds.

The trailing section 31 is substantially frusto-conical in shape except that the surface includes convex line segments extending from the base 21 and the apex 25. This convex surface gives added support to resist the bending loads acting on the insert as it contacts the borehole bottom.

Again, it should be noted that the trailing section 31 blends with the leading section 29 and the apex 25 without any sharp radii being formed to create stress risers. This is in conformance with teachings found in Assignee's U.S. patent application Ser. No. 08/045,444, filed Apr. 8, 1993.

This is illustrated in FIGS. 3 and 4 where the surface intersections with planes 32, 33, 34 and 35 shown in FIG. 3 are shown in FIG. 4. In FIG. 4, these surface intersections are circular in the preferred embodiment, but may be non-circular.

Figure 6:
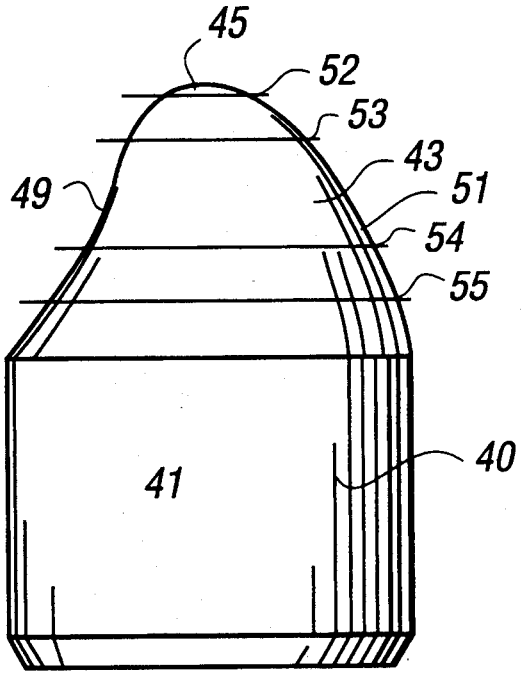
FIG. 6 is a side elevational view of the insert shown in FIG. 5.
Figure 5:
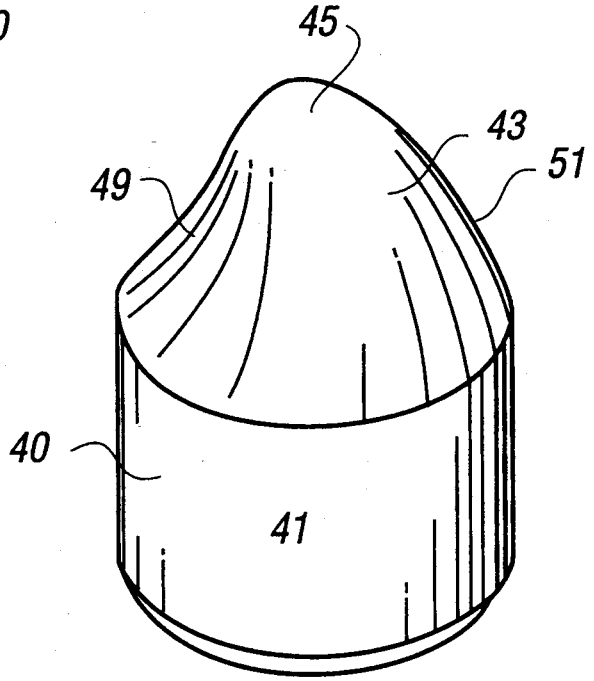
FIG. 5 is a perspective view of the second embodiment of the insert made in accordance with the present invention.
Figure 7:
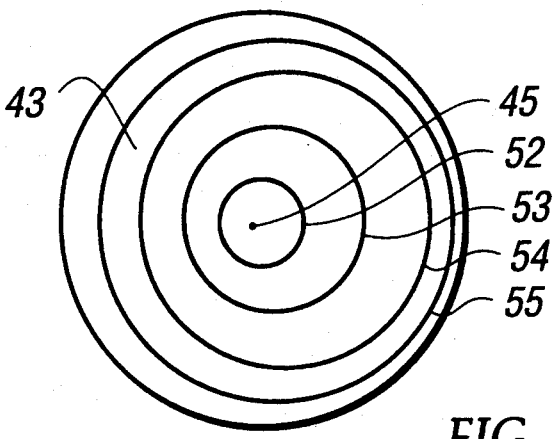
FIG. 7 is a top elevational view of the insert shown in FIG. 5.

FIGS. 5–7 illustrate the second embodiment of the present invention. This embodiment shows an insert 40 having a cylindrical base 41 which also is adapted to extend entirely within bores formed on the cone surface.

Each insert 40 also includes a cutting tip 43 mounted on the base 41 which is adapted to extend beyond the surface of the cone.

As in the explanation of the first embodiment, each cutting tip 43 can be separated into three sections. The first section 45 is substantially similar to the rounded apex 25 of the first embodiment. Similarly, the trailing section 51 is substantially similar to the convex surface 31 of the first embodiment.

The actual difference in structure lies in the leading section 49. Rather than having straight line segments from the base 41 to the apex 45, the leading section 49 is a concave surface by having lined segments which are bowed inwardly as they extend from the base normally to the apex.

As with the first embodiment, it should be noted that the trailing section 51 transitions with the leading section 49 and the apex 45 without any sharp intersections requiring a blend radius. In fact, as illustrated in FIG. 7, the surface intersections with planes 52, 53, 54 and 55, shown in FIG. 6 are substantially true circles because the amount that the convex lines is in distance from a straight line extending from the base to the apex is substantially the same distance that the concave lines would have. However, it should be noted that the amount of concavity of the leading surface does not necessarily have to equal the amount of the trailing surface is convex.

In effect, the horizontal slices taken through the cutting tip 41 would show a series of circles which centers would form a curved line leading from the base to the apex.

It should also be noted that the center of the apex 45 is concentric with the axis of the cylindrical base 41. It would fall within the purview of this invention to have the apex 45 be asymmetrical with the base axis in any direction.

It will of course be realized that various modifications can be made in the design and operation of the present invention without departing from the spirit thereof. Thus while the principal preferred construction and mode of operation of the invention have been explained in what is now considered to represent its best embodiments, which have been illustrated and described, it should be understood that within the scope of the appended claims the invention may be practiced otherwise than as specifically illustrated and described.

What is claimed is:

1. In combination with a rolling cone drill bit of the insert type, a shaped insert having a cylindrical base integrally jointed to a non-symmetric cutting tip, the cutting tip having a leading side and a trailing side converging to a spherically rounded apex with the trailing side being convex as seen in a longitudinal section taken normal to the apex.

2. The invention of claim 1 wherein the leading side includes straight line segments extending between the apex and the cylindrical base.

3. The invention of claim 1 wherein the leading side is concave as seen in a longitudinal section taken normal to the apex.

4. The invention of claim 1 wherein the spherical apex is concentric to the axis of the cylindrical base.

5. The invention of claim 2 wherein the spherical apex is concentric to the axis of the cylindrical base.

6. The invention of claim 3 wherein the spherical apex is concentric to the axis of the cylindrical base.

7. The invention of claim 1 wherein the spherical apex is offset from the axis of the cylindrical base.

8. The invention of claim 2 wherein the spherical apex is offset the axis of the cylindrical base.

9. The invention of claim 3 wherein the spherical apex is offset from the axis of the cylindrical base.

10. The invention of claim 1 wherein a portion of the planar sections taken perpendicular to the axis of the cylindrical base are circular in shape.

11. The invention of claim 1 wherein a portion of the planar sections taken perpendicular to the axis of the cylindrical base are non-circular in shape.

12. In combination with a rolling cone drill bit of the insert type, a shaped insert having a cylindrical base integrally jointed to a non-symmetric cutting tip, the cutting tip having a leading side and a trailing side converging to a spherically rounded apex, the trailing side being convex as seen in a longitudinal section taken normal to the apex, the cutting tip surface below the apex being shaped to have a continuous contoured surface without any sharp intersections requiring blend radii.

13. The invention of claim 12 wherein the leading side is concave as seen in a longitudinal section taken normal to the apex.

14. The invention of claim 12 wherein the leading side includes straight line segments extending between the apex and the cylindrical base.

15. The invention of claim 12 wherein the spherical apex is offset to the axis of the cylindrical base.

16. The invention of claim 13 wherein the spherical apex is offset to the axis of the cylindrical base.

17. The invention of claim 14 wherein the spherical apex is offset to the axis of the cylindrical base.

18. The invention of claim 12 wherein a portion of the planar sections taken perpendicular to the axis of the cylindrical base are circular in shape.

19. The invention of claim 12 wherein a portion of the planar sections taken perpendicular to the axis of the cylindrical base are non-circular in shape.

* * * * *